US008006417B2

(12) United States Patent
Montell

(10) Patent No.: US 8,006,417 B2
(45) Date of Patent: Aug. 30, 2011

(54) TUBE-LIKE ADVERTISING DEVICE THAT IS FIXED BETWEEN TWO STRUCTURAL MEMBERS AND INCLUDES A CLEAR OUTER MEMBER

(75) Inventor: Aaron Montell, Centennial, CO (US)

(73) Assignee: Pole Postitioning, LLC, Denver, CO (US)

( * ) Notice: Subject to any disclaimer, the term of this patent is extended or adjusted under 35 U.S.C. 154(b) by 0 days.

(21) Appl. No.: 12/111,789

(22) Filed: Apr. 29, 2008

(65) Prior Publication Data

US 2008/0271353 A1 Nov. 6, 2008

Related U.S. Application Data

(60) Provisional application No. 60/915,452, filed on May 2, 2007.

(51) Int. Cl.
*G09F 13/00* (2006.01)

(52) U.S. Cl. ..... 40/431; 52/38; 52/849; 482/33

(58) Field of Classification Search ..... 40/430, 40/493, 660, 431; 482/33, 51, 131; 52/301, 52/126.6, 126.7, 127.2, 831, 849, 38; 248/200.1
See application file for complete search history.

(56) References Cited

U.S. PATENT DOCUMENTS

| | | | | | |
|---|---|---|---|---|---|
| 1,374,026 | A * | 4/1921 | Nelson | 211/105.4 |
| 4,164,084 | A * | 8/1979 | Crockett | 40/660 |
| 5,570,541 | A * | 11/1996 | Hering | 49/47 |
| 5,979,113 | A * | 11/1999 | Hering | 49/47 |
| 6,148,552 | A * | 11/2000 | Dumontier et al. | 40/473 |
| 6,584,713 | B2 * | 7/2003 | Huang | 40/431 |
| 2004/0220031 | A1 * | 11/2004 | Blacker | 482/148 |
| 2008/0146423 | A1 * | 6/2008 | Ammon et al. | 482/131 |

* cited by examiner

*Primary Examiner* — Joanne Silbermann
(74) *Attorney, Agent, or Firm* — Jason H. Vick; Sheridan Ross P.C.

(57) ABSTRACT

An advertising device, where one exemplary use is as a "stripper pole" having associated ad material. The ad material can be placed inside a portion of the pole and be visible through a protective cover, and be dynamic. Additionally, the stripper pole may be in a variety of sizes and shapes and may include lighting, rotating mechanisms, engraving and suspended objects. The advertising device includes a connecting element that attaches to at least one end, and optionally between two ends, with a gap between an inner element and an outer element where advertising material can be placed in the gap.

18 Claims, 7 Drawing Sheets

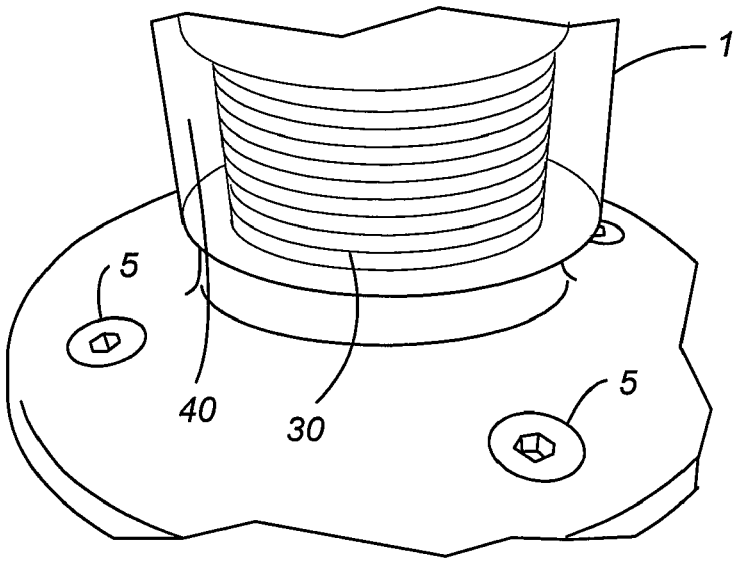
Fig. 6
Fig. 8
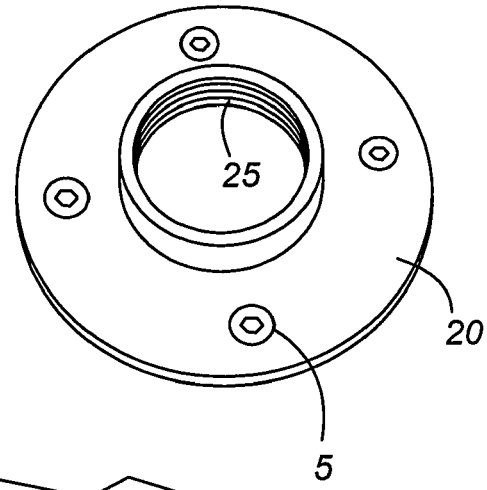
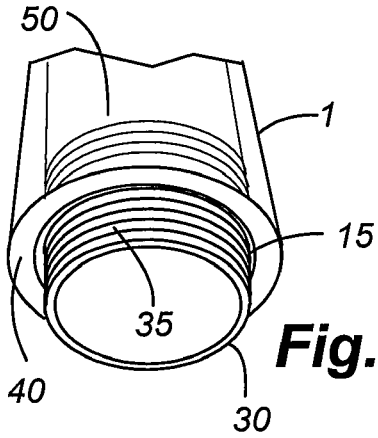
Fig. 7
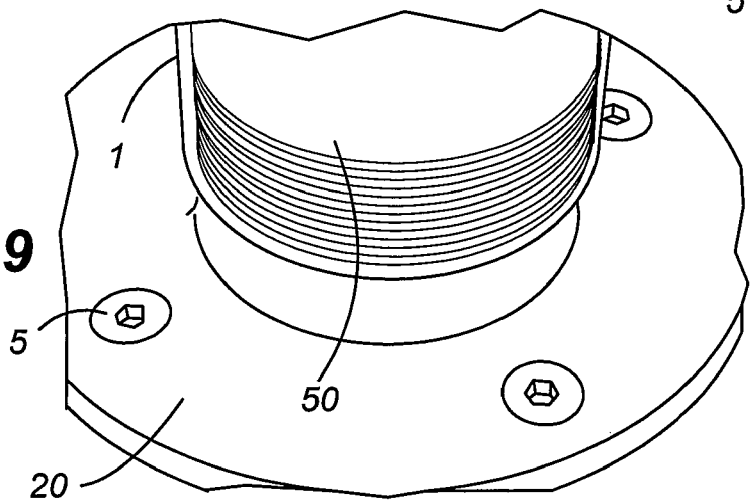
Fig. 9

TUBE-LIKE ADVERTISING DEVICE THAT IS FIXED BETWEEN TWO STRUCTURAL MEMBERS AND INCLUDES A CLEAR OUTER MEMBER

RELATED APPLICATION DATA

This application claims the benefit of and priority under 35 U.S.C. §119(e) to U.S. Provisional Application No. 60/915,452, filed May 2, 2007, entitled "Advertising Device," which are incorporated herein by reference in its entirety.

FIELD OF THE INVENTION

The exemplary embodiments described herein are directed toward various configurations of an advertising device. More particularly, exemplary aspects are directed toward an advertising device secured between secure surfaces, such as a floor and a ceiling.

SUMMARY

Exemplary embodiments of the advertising device can be used to help create brand awareness in a non-traditional manner. Advertising reaches a variety of demographics; and the use of indoor advertising by national, regional, and local advertisers has increased dramatically in recent years, in part, due to its ability to target a specific market.

Advertisers are attracted to this medium for a number of exemplary reasons including:

The opportunity to reach a captive audience.

The ability to target by age, gender, income, lifestyle, geography and/or other criteria.

The capability to reach people who are on the move and are otherwise difficult to reach with other media.

It's a low cost, affordable ad medium.

The audience is active and usually in a positive frame of mind at locations where indoor advertising is placed.

People are spending money at the sites; and the audience typically has discretionary income.

While the disclosed embodiments will be described in relation to the advertising device used in a specific environment, in general the advertising device can be used in any location where it can be secured, for example, between two surfaces, such as a floor and ceiling, or secured by at least one end to a surface.

An exemplary use of the described advertising device is in night clubs, such as gentlemen's clubs, topless clubs, nude clubs, pasties clubs, bikini clubs, night clubs, modeling studios and traditional dance clubs. For these applications, a performer can utilizing the advertising device as a traditional "stripper pole" with the added benefit of there being advertising associated with the advertising device.

An additional exemplary use of the advertising device is a toy, such as a piece of playground equipment, as a grab-pole in a bus, subway, public place, or the like. The playground equipment could display, for example, socially constructive message(s) such as "Brush your Teeth," while the grab-pole embodiment could display safety information such as "Hold On!—the train is approaching the station."

An additional aspect of the invention allows the advertisements associated with the advertising device to be interchangeable or dynamic.

An additional aspect of the invention allows 360° viewable advertisements.

An additional aspect of the invention provides a secure advertising medium capable of supporting the weight of one or more people.

An additional aspect of the invention is directed toward having an advertising device with one or more removable ends to facilitate changing of an ad housed by the advertising device.

An additional aspect of the invention relates to an advertising device having dynamically updateable content.

Additional aspects of the invention relate to an advertising device constructed such that a load acting on the outermost member is substantially transferred to an inner member via portions of one or more ads.

Still further aspects of the invention relate to securing one or more ads to one or more of an inner diameter of an outer member or an outer diameter of an inner member with the one or more ads at least partially displayed through the outer member.

Aspects of the invention further relate to a stripper pole having one or more stickers or decals associated therewith.

Aspects of the invention further relate to a sticker adapted to be attached to a stripper pole.

Aspects of the invention further relate to an advertising device, having a height to width ratio of any value between 40:1 to 80:1, wherein advertising associated with the advertising device is at least partially covered by a protective cover.

These and other features and advantages of this invention are described in, or are apparent from, the following detailed description of the exemplary embodiments.

BRIEF DESCRIPTION OF THE DRAWINGS

The exemplary embodiments of the invention will be described in detail, with reference to the following figures wherein:

FIGS. 1-16 illustrate exemplary embodiments of an advertising device from various angles.

DETAILED DESCRIPTION

Figure 1:
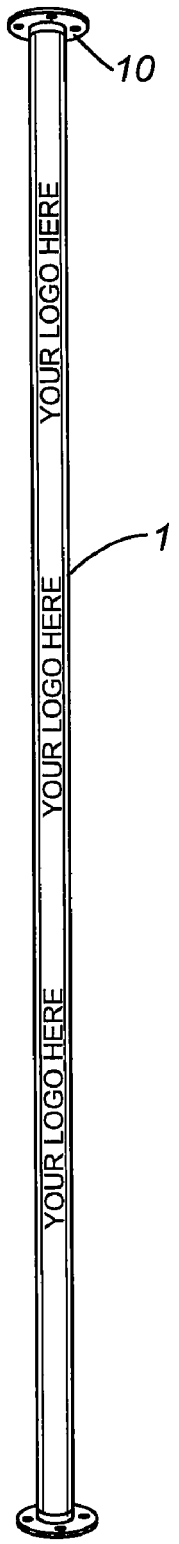
Figure 2:
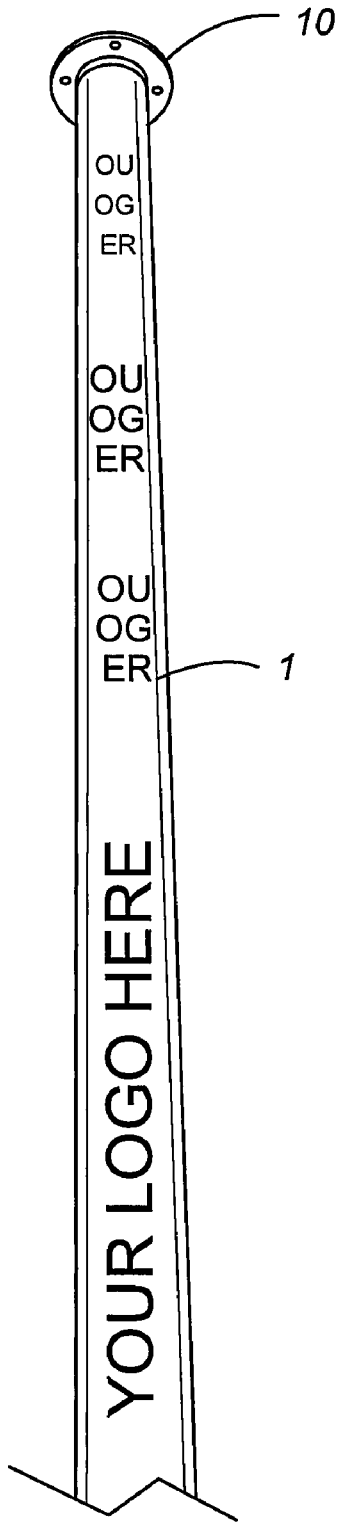
Figure 3:
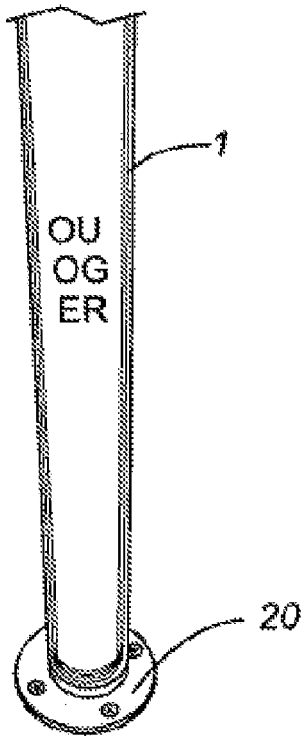
Figure 4:
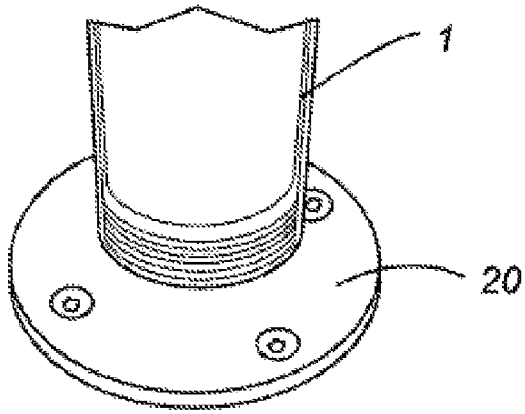
Figure 5:
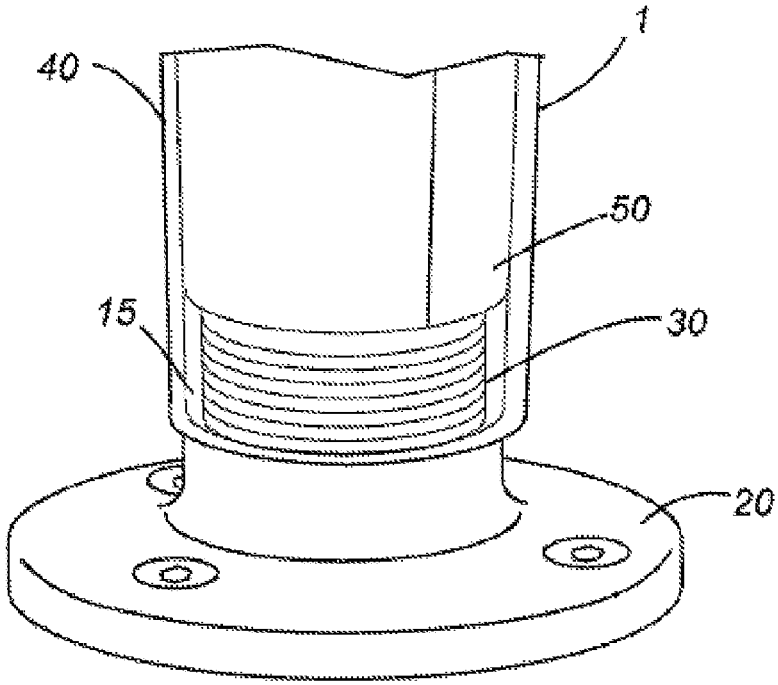

For purposes of explanation, numerous details are set forth in order to provide a thorough understanding of the present invention. It should be appreciated however that the present invention may be practiced in a variety of ways beyond the specific details set forth herein, and may be made out of different materials, of differing transparency, in different shapes with differing ratios of one member to another.

FIGS. 1-16 illustrate exemplary embodiments of the advertising device. In general, the advertising device 1 comprises first 10 and second ends 20 adapted to receive a first member 30, such as a cylinder. The first 10 and second 20 ends can be attached via one or more fasteners 5 to a ceiling and floor, respectively, with the cylinder extending therebetween. The cylinder and ends are constructed to be able to bear the weight of, for example, a force acting on the cylinder by, for example, a user.

A second member 40, such as a hollow cylinder is adapted to be fitted around the cylinder, in either a rotatable or fixed manner. For example, if the cylinder can be an 8'-12' piece of approximately 2" diameter pipe, the hollow cylinder can be a corresponding 8'-12' polycarbonate clear tube having dimensions of approximately 2" ID×2½" OD and configured to allow the hollow cylinder to fit over the cylinder and providing a gap 15 for the insertion of an ad 50, and a ratio of height to width of approximately 48:1 to 60:1. The ad 50 can be interchangeable, and on a piece of media, such as paper, plastic, cardboard, a film, vinyl, LCD, a photograph, or the like, which is placed in the gap 15 between the cylinder and the hollow cylinder.

It should be appreciated however that the gap 15 between the cylinder and the hollow cylinder can be varied to accommodate different types of ads, such as 2-D and 3-D ads, differing thicknesses of an ad 50, such as paper, cardboard, a display device, such as an LCD, and the like. Additionally, one or more spacers (120, 122) could be included in this gap 15 to assist in preventing the hollow cylinder from flexing relative to the cylinder.

In accordance with one exemplary embodiment, the first member and the second member could be configured such that a load on the second member is transferred to the first member via the ad(s) or a portion thereof, and/or transferred directly from the second member to the first member. Spacers could also be used to separate different ads. For example, describing an exemplary configuration from the from the bottom of the advertising device upward, in the gap 15 could be a spacer, a cardboard ad, another spacer, an LCD, another spacer, another cardboard ad and a final spacer.

The spacers could be rings of material such as plastic, bearings, wood or a wood product, a composite material, metal, or in general any material. The spacers could be adapted to either cooperate with the first and second member to provide a frictional fit to restrict the movement of the second member relative to the first member or could isolate the second member 40 from the first member 30.

As shown in detail in FIGS. 6-9, the cylinder can be a piece of pipe, threaded 35 at both ends and, and for this exemplary embodiment, has an outer diameter of less than 2". Fasteners 5, such as hex bolts, are used to secure the ends 10 and 20 to secure surfaces, such as a floor and ceiling. It should be appreciated however that both ends 10 and 20 need not necessarily be secured to respective surfaces, but in an alternative configuration only one end 10 or 20 is secured.

Ad material 50 is associated with the cylinder, through, for example, paint, friction, glue, or the like, or can be placed in the gap 15 defined to be between the outer diameter of the cylinder (first member 30) and the inner diameter of the hollow cylinder (second member 40). Alternatively, the ad 50 may sit freely in the space between the outer diameter of the cylinder and the inner diameter of the hollow cylinder. The gap 15 allows the ad material 50 to be changeable, if desired, and the first member 30 and second member 40 can be adapted to allow varying types of ad 50 thickness.

In accordance with an exemplary embodiment, assembly of an advertising device is as follows with reference to FIGS. 7-10, where ad material 50 made of paper is placed in the gap 15. For this exemplary embodiment, threaded flanges 10, 20 are secured to the threaded 35 ends of the cylinder, such as a pipe. A first threaded flange 10 or 20 is threaded onto to a corresponding first end of the pipe.

Association of the ad material can occur in at least 2 ways. First, the polycarbonate tubing, i.e., second member, can be placed over the pipe, i.e., first member. A piece of vinyl or other media as the ad material 50 including an ad or graphic is placed in between the pipe and the clear polycarbonate tubing. A second flange is threaded on to the opposite end of pipe. The polycarbonate tubing is thus held in place between the two ends, around the pipe and ad material 50. The compressive pressure on the polycarbonate tubing can be adjusted by tightening or loosening the flanges at either end. The flanges are bolted to respective secure surfaces using, for example, 8 hex bolts 5.

Second, a piece of vinyl or other media as the ad material 50 is at least partially wrapped around the pipe. The ad material 50 can optionally be held in place by a fastener(s), tape or adhesive. The clear polycarbonate or plastic tubing, i.e., second member, is slid over the pipe, i.e., first member, and the ad material 50. A second flange is threaded on to the opposite end of pipe. The polycarbonate tubing is thus held in place between the two ends, around the pipe and ad material 50. The compressive pressure on the polycarbonate tubing can be adjusted by tightening or loosening the flanges at either end. The flanges are bolted to respective secure surfaces using, for example, 8 hex bolts 5.

Additional components of the advertising device 1 (discussed hereinafter) could include lighting, a rotation mechanism for rotating one or more of the ad and the advertising device 1, and different shaping of one or more of the first and second member to accommodate different advertisers. (e.g., if the client is a beer producer, one or more of the first and second member may be shaped like a can/bottle.) In general, one or more of the first and second member can be in any shape.

Furthermore, any one or more of the components could include engraving or etching that could, for example, be used in combination with lighting, paint, or the like, to enhance the visibility of the engraving or etching.

The second member can be configured to fit freely over the pipe, optionally including one or more spacers as discussed above, however tightening one or both of the flanges at either end, can act like a vise against the second member optionally limiting or preventing the second member from moving relative to the first member.

Figure 10:
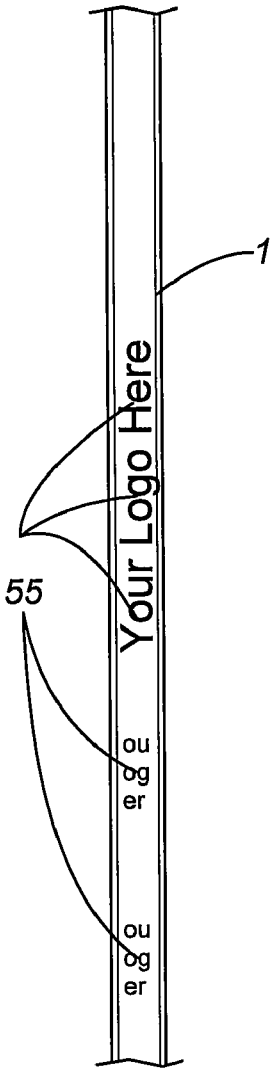
Figure 11:
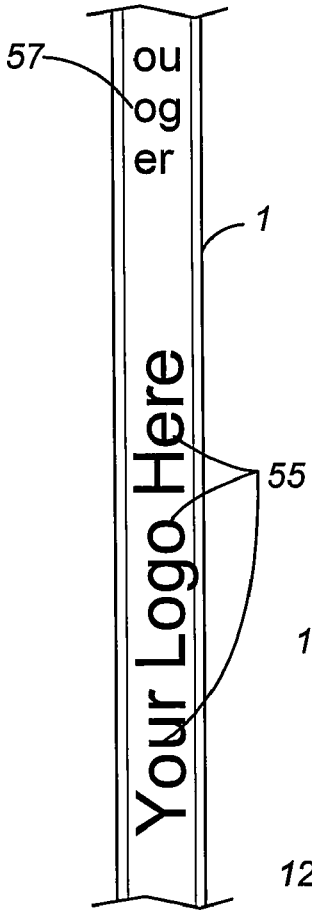

FIG. 10 illustrates an exemplary advertising device 1 including a plurality of ads 55. The ads 55 can be placed in various locations throughout the advertising device 1 and can be in general in any orientation relative to the advertising device 1 including, horizontally, perpendicularly, diagonally, or the like. As illustrated in FIG. 11, the ads 55 can be configured such that they are viewable in their entirety from a specific location or as illustrated by ad 57, can wrap around or partially around the advertising device 1 such that only a portion of the ad is visible from a specific location.

Figure 12:
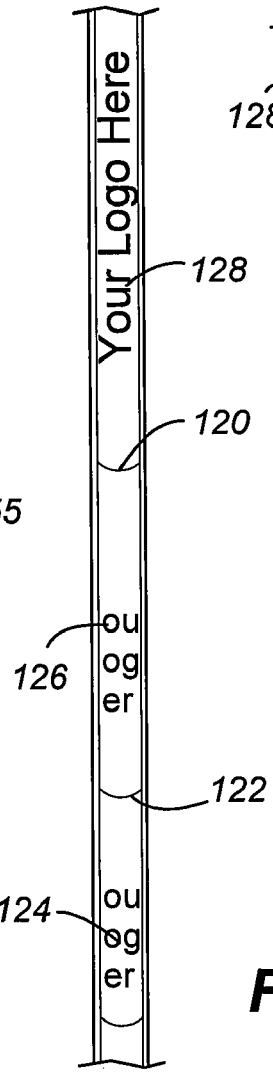
Figure 13:
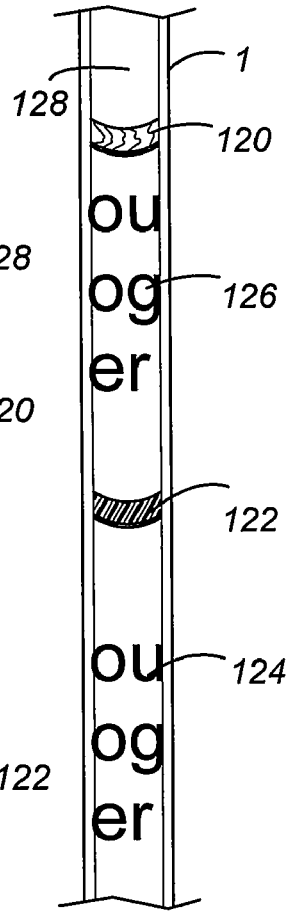

FIG. 12 illustrates an exemplary embodiment where spacers 120 and 122 are used to separate ad 124, ad 126 and ad 128. FIG. 13 illustrates an exploded view of FIG. 12 where the spacers 120 and 122 can be more clearly seen between the ads 124, 126 and 128. In this exemplary embodiment, the ads 124, 126 and 128 are printed on media, such as cardboard tubing, and the cardboard tubing placed in the gap 15 with the spacers 120 and 122 utilized to separate the various ads. The spacers 120 and 122 can be colored so as to provide a continuous look to ads in the advertising device 1, or alternatively can be distinctly colored to act as a separator between the ads. For example, spacer 122 could be a first color, while the background of ads 124 and 126 could be a second color.

Figure 14:
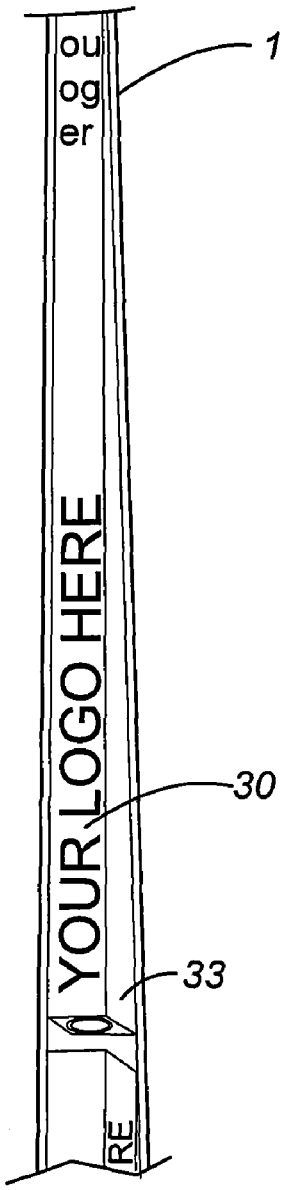
Figure 15:
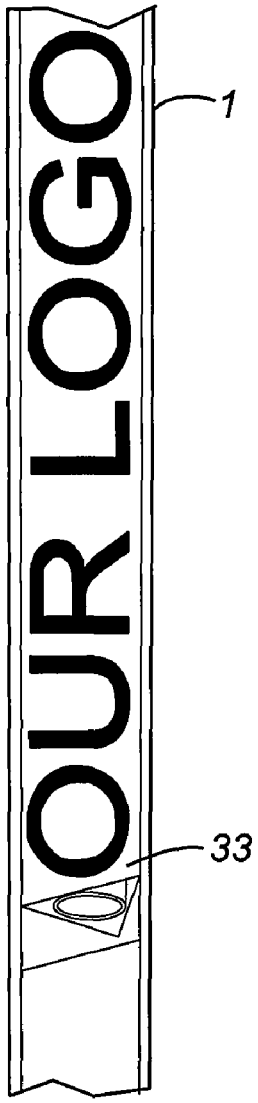
Figure 16:
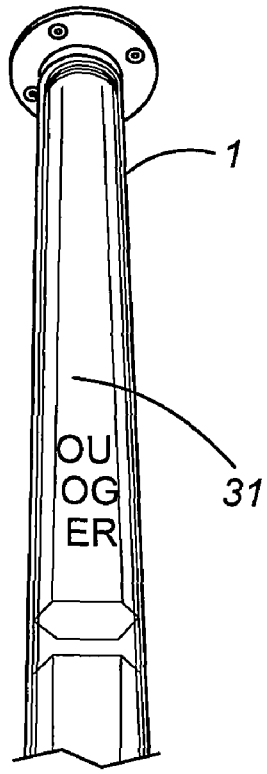

While the previously discussed embodiments have been directed toward a configuration where the first member and the second member are tubular, FIGS. 14-16 illustrate alternative exemplary embodiments where the not only may the first member be a different shape than the second member, but there may be a support 33 with which one or more ads can be associated that is of a different shape than one or more of the first member and the second member. For example, in FIG. 14 the first member 30 is round tubing, and the support 33 is square, while in the embodiment illustrated in FIG. 15, the support 33 is, in cross-section, triangular shaped. In the embodiment illustrated in FIG. 16, the first member 31 is a polygon, such as a pentagon, hexagon, octagon, or in general, any polygon. For the embodiments illustrated in FIGS. 14-16, one or more of the support 33 and the first member 30 can be configured such that a portion, such as the edges, of the first member or support contact the inner portion of the second member so as to provide a structural interrelationship therebetween, and thus is adapted to carry a portion of a force acting on the second member 40. In general, the first member provides a majority of the load bearing capabilities of the advertising device with the second member carrying less of the load. While load could be shared between the first and second members (optionally in conjunction with the support 33), in these exemplary embodiments, the advertising device 1 is constructed such that the first member is the primary load bearing member.

Figures 17, 18, 19, 20:
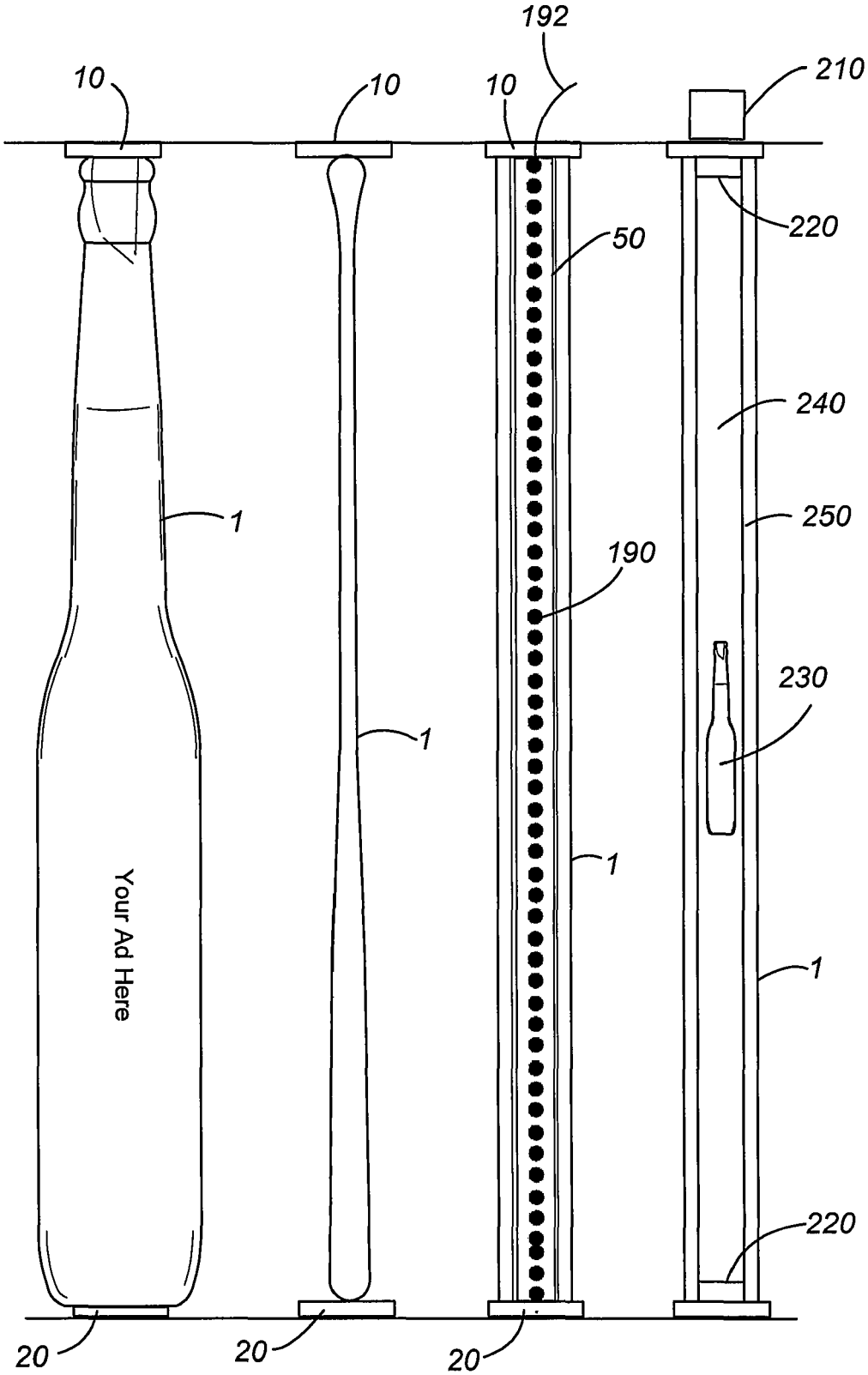
FIG. 17 illustrates an additional exemplary configuration of the advertising device where the advertising device has a certain shape.
FIG. 18 illustrates an additional exemplary configuration of the advertising device where the advertising device illustrating another exemplary embodiment having a certain shape.
FIG. 19 illustrates an additional exemplary configuration of the advertising device with included lighting.
FIG. 20 illustrates an additional exemplary configuration of a moving advertising device that includes an optional embedded object.

FIG. 17 illustrates an exemplary embodiment where the advertising device 1, has a specific shape. While a beer bottle is illustrated, it should be appreciated that any shape can be used. Furthermore, while the first and second member can have complementary shapes, it should be appreciated that this is not required and the use of, for example, spacers in the gap 15 would allow for the first and second members to have differing shapes.

FIG. 18 illustrates an embodiment where the advertising device 1 is baseball bat shaped. As above, while the cylinder associated with the hollow cylinder may have similar shapes, it is not necessary. Alternatively, the advertising device 1 may just comprise a single elongated member that extends between the first and second ends 10 and 20. The advertising device may be attached to the first and second ends through any securing means and is not limited to the threaded relationship discussed above. Alternatively, the first and second ends could be integrated with the elongated device to be, for example, one piece that could be secured between fixed surfaces such as a floor and ceiling.

The elongated member can be in any shape, may optionally be solid or hollow, or some combination thereof, and can include advertisements or finishes, so as to appear, for example, as a wooden baseball bat. The finishes and/or ads can be optionally painted, laminated, a sticker or decal, transferred or otherwise associated with the elongated member and a clear finish, such as polyurethane, optionally applied thereover.

FIG. 19 illustrates an embodiment where both the cylinder and the hollow cylinder are made of a transparent or semi-transparent material, such as plastic, and more specifically a high strength plastic. Inside of the advertising device 1 are one or more lights, such as LED's, a fluorescent tube, or the like. The lights are connected via an electrical cord(s) 192 to one or more of a power supply and controller (not shown) which allow for one or more of luminosity, color, intensity and pattern control of the one or more lights 190. While the exemplary lights 190 are illustrated as LED's in a single-strip configuration, it should be appreciated that the lights 190 can be in an array to support, for example, scrolling text. In addition to being a flat array, the array could be circular-shaped in cross-section allowing, for example, the advertising to appear to scroll around the advertising device 1. Alternatively, the advertising device 1 can be illuminated from one or both ends, by, for example, including a lighting source in one or more of the first or second ends 10 and 20, or including a recessed lighting source in one or more of the floor and ceiling with the lighting source shining through the ends 10 and 20, thus providing illumination of the advertising.

FIG. 20 illustrates another exemplary embodiment where the securing mechanism holding the advertising device 1 is rotated by a drive mechanism 210. Bearings 220 can be included to assist with the rotation of the mechanism holding the advertising device 1. This embodiment, like the other embodiments, can be combined with one or more of the other features discussed herein.

Alternatively, or in addition, the process of embedding object(s) 230 can be used with this invention such that the first member 240 can have integrated therewith and/or suspended therein designs, ads, objects, or the like. For example, in FIG. 20, a beer bottle is the embedded object 230.

Figure 21:
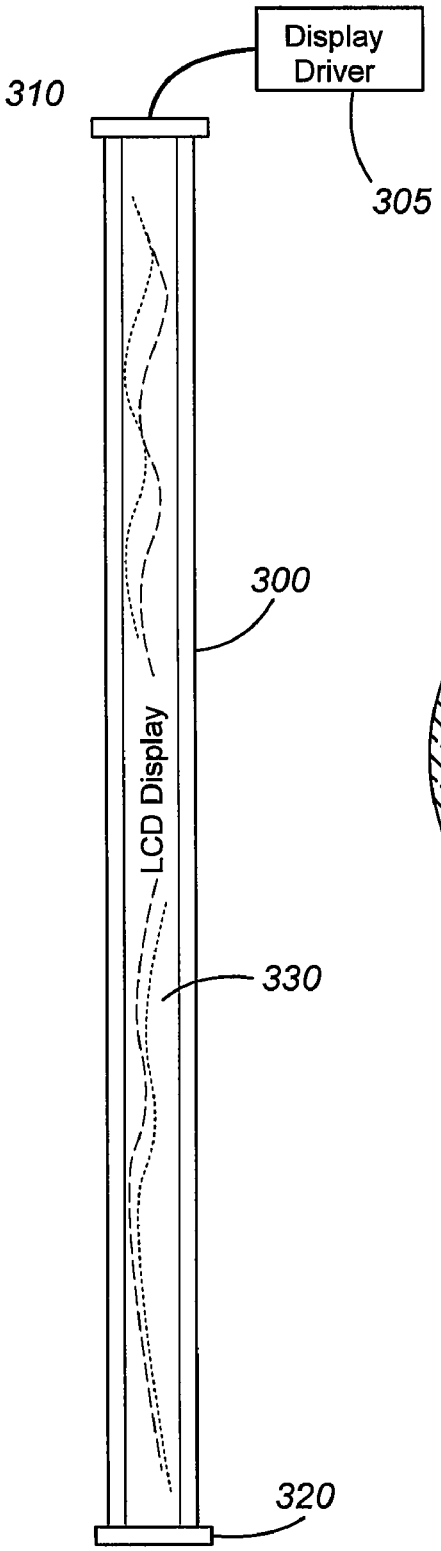
FIG. 21 illustrates an embodiment of the advertising device with an electronically changeable advertisement.
Figure 22:
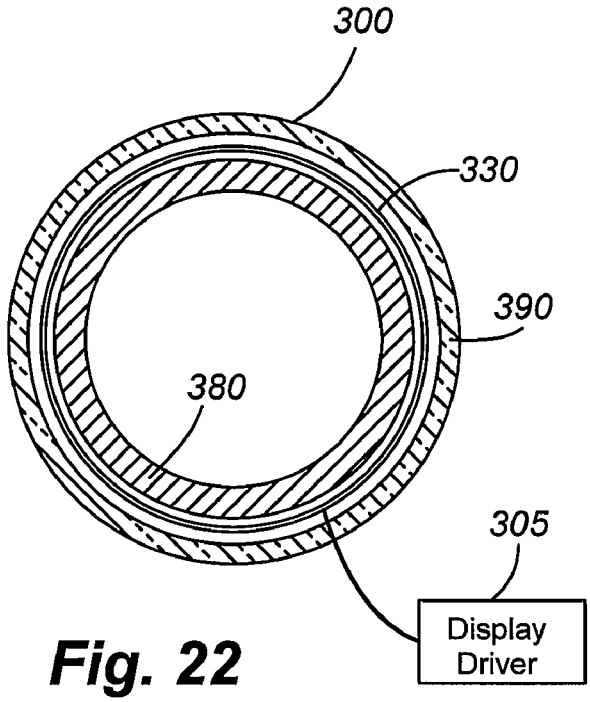
FIG. 22 illustrates a cross-section of FIG. 21.

FIGS. 21 and 22 illustrate an additional exemplary embodiment of an advertising device 300 that includes an LCD display 330. Content, such as an advertisement, graphic, or the like can be displayed on the LCD display 330 and dynamically changed, updated or modified as needed. Similar to the other environments, the advertising device 300 includes a first end 310 and a second end 320 which allows for the advertising device 300 to be secured to support surfaces. In addition, a display driver 305 is included that allows for one or more of power supply and management of the content displayed on the LCD display 330.

FIG. 22 illustrates in cross-section the advertising device 300. The LCD display 330, such as a flexible LCD, is sandwiched between the first member 380 and the second member 390. While for ease of illustration a gap is shown on either side of the LCD display 330, it should be appreciated that this gap need not be present with the LCD 330 sandwiched between the first member 380 and the second member 390 providing communication between the inner member 380 and the outer member 390.

While the exemplary embodiments have been described in relation to specific components and materials, it should be appreciated that in general the advertising device can be any component, or combination of components providing a secure element held in place by one or more end points, the element having a protective cover for the protection of one or more ads. For example, the protective cover can be clear or tinted plastic tubing, and the element can be metal, with the one or more ads between the element and the protective cover. Alternatively, the protective cover need not be used, and the element between the end points could be, for example, solid. For example, the element between the two points securing the device can be made into a specific shape, such as that illustrated in FIG. 18. The shape of the end points can also be modified to, for example, correspond to the overall theme, color, and/or shape of the ad.

It is therefore apparent that there has been provided, in accordance with the present invention, an advertising device. While this invention has been described in conjunction with a number of embodiments, it is evident that many alternatives, modifications and variations would be or are apparent to those of ordinary skill in the applicable arts. Accordingly, it is intended to embrace all such alternatives, modifications, equivalents and variations that are within the spirit and scope of this invention.

The invention claimed is:

1. An advertising device comprising:

a first end;

a second end; and a connecting element, wherein:

the first and second ends are secured to respective structural surfaces with one or more fasteners with the connecting element therebetween, the structural surfaces being a ceiling and a floor, the connecting element includes a first member and a second member, the first member having an outer diameter less than an inner diameter of the second member thereby creating a gap therebetween, the first member and the second member each having a height to width ratio of at least 48:1, the first member comprising a first threaded portion and a second threaded portion secured to the first end and the second end, respectively, the first member adapted to carry a majority of a load on the advertising device, the second member being compressed between the first end and the second end, the second member comprising polycarbonate, the gap between the outer diameter of the first member and the inner diameter of the second member houses one or more interchangeable ads, and the one or more interchangeable ads filling a majority of the gap such that the load is transferred from the second member to the first member via the one or more interchangeable ads.

2. The device of claim 1, wherein the load is the weight of a user.

3. The device of claim 1, wherein the one or more ads are printed media that is placed in the gap.

4. The device of claim 1, wherein one or more of the first member and second member are one or more of transparent and semi-transparent.

5. The device of claim 1, wherein one or more of the first and second member are rotatable by a drive mechanism.

6. The device of claim 1, wherein one or more of the first and second member have a predetermined shapes.

7. The device of claim 6, wherein the predetermined shape corresponds to an advertisement.

8. The device of claim 1, further comprising one or more objects located in one of the first and second member.

9. The device of claim 1, wherein the first member is steel and the second member is one or more of a clear and semi-transparent plastic.

10. The device of claim 1, wherein the first member is threadedly secured to the first and second ends.

11. The device of claim 1, wherein the second member is radially proximate to the first member, with a volume defined therebetween housing the one or more ads.

12. The device of claim 1, further comprising one or more spacers included in the gap and transferring the load from the second member to the first member.

13. The device of claim 1, further comprising an embedded object in the first member.

14. The device of claim 1, wherein the first member is of a different shape than the second member.

15. The device of claim 1, wherein the one or more interchangeable ads comprises at least two interchangeable ads separated by one or more annular spacers.

16. An advertising system comprising:

first and second ends respectively secured to a ceiling and a floor, a first tubular member and a second tubular member, secured at each end to respective first and second ends, which is at least one of transparent and semi-transparent, the first member having an outer diameter less than an inner diameter of the second member, wherein a volume is defined therebetween, the first tubular member comprising a first threaded portion and a second threaded portion secured to the first end and the second end, respectively, the second tubular member being compressed between the first end and the second end, wherein the volume receives one or more of an interchangeable and dynamic ad that is displaced between the first and second members, and wherein the one or more of the interchangeable ad and the dynamic ad fill a majority of the volume such that a load is transferred from the second tubular member to the first tubular member via the one or more of the interchangeable ad and the dynamic ad.

17. The advertising device of claim 16, wherein the tubular members are one or more of cylindrical and partially cylindrical.

18. The advertising device of claim 16, wherein the first member is adapted to carry a majority of a load acting on the advertising system.

* * * * *

UNITED STATES PATENT AND TRADEMARK OFFICE

CERTIFICATE OF CORRECTION

PATENT NO. : 8,006,417 B2
APPLICATION NO. : 12/111789
DATED : August 30, 2011
INVENTOR(S) : Aaron Montell It is certified that error appears in the above-identified patent and that said Letters Patent is hereby corrected as shown below:

On the Title Page, Item (73), line 6, delete "Postitioning" and insert --Positioning--

Signed and Sealed this
Fourth Day of October, 2011

David J. Kappos

David J. Kappos
*Director of the United States Patent and Trademark Office*